US007143870B2

(12) United States Patent
Watabe et al.

(10) Patent No.: US 7,143,870 B2
(45) Date of Patent: Dec. 5, 2006

(54) ELEVATOR HALL DOOR AND DOOR HANGER APPARATUS

(75) Inventors: Masato Watabe, Fussa (JP); Hisato Ito, Kiyose (JP)

(73) Assignees: Kabushiki Kaisha Toshiba, Tokyo (JP); Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/281,341

(22) Filed: Nov. 18, 2005

(65) Prior Publication Data

US 2006/0075708 A1 Apr. 13, 2006

Related U.S. Application Data

(62) Division of application No. 10/070,427, filed as application No. PCT/JP01/06178 on Jul. 17, 2001, now Pat. No. 6,988,592.

(30) Foreign Application Priority Data

Jul. 17, 2000 (JP) ..... 2000-215696
Jan. 24, 2001 (JP) ..... 2001-016142

(51) Int. Cl.
*B66B 13/02* (2006.01)

(52) U.S. Cl. ..... 187/313; 187/314; 187/325; 49/116; 49/120; 52/30; 52/232; 52/784.11

(58) Field of Classification Search ..... 187/313, 187/314, 324, 333, 334, 336; 49/120, 116, 49/360, 425, 1, 409; 16/86.2, 96 R, 102, 16/106; 52/1, 30, 232, 784.1, 784.11
See application file for complete search history.

(56) References Cited

U.S. PATENT DOCUMENTS 982,303 A 1/1911 Saino et al.
1,146,960 A 7/1915 Saino
1,195,505 A 8/1916 Saino
1,204,074 A 11/1916 Saino
1,315,659 A 9/1919 Drab
1,377,298 A 5/1921 Wheeler
1,395,766 A 11/1921 Phillips
1,451,353 A 4/1923 Waldman
1,724,052 A 8/1929 Swearengin
3,425,162 A * 2/1969 Halpern ..... 49/425
3,451,095 A * 6/1969 Kiefer ..... 16/107
3,981,102 A 9/1976 Harwood et al.
4,597,229 A 7/1986 Minialoff et al.

(Continued)

FOREIGN PATENT DOCUMENTS

JP 54-075834 6/1979

(Continued)

*Primary Examiner*—Kathy Matecki
*Assistant Examiner*—Stefan Kruer
(74) *Attorney, Agent, or Firm*—Oblon, Spivak, McClelland, Maier & Neustadt, P.C

(57) ABSTRACT

A door panel comprises a surface board 11 facing a hoistway, a back board 12 facing a hoistway, and a reinforcing member 13 for reinforcing the surface board 11 and the back board 12 . The back board is connected to the surface board or the reinforcing member by a connecting member 15 which is capable of losing the force of constraint against the surface board or the reinforcing member on high temperature conditions during a fire. This connecting member 15 prevents the door panel of the elevator hall door from being deformed during a building fire, and prevents the elevator hall door from falling, thus preventing smoke and flame from entering the hoistway.

5 Claims, 9 Drawing Sheets

U.S. PATENT DOCUMENTS 4,987,638 A * 1/1991 Ribaudo ..... 16/89
5,165,505 A 11/1992 Hayashi et al.

FOREIGN PATENT DOCUMENTS

JP 61-83769 6/1986
JP 01197296 8/1989
JP 7-42066 5/1995
JP 2000-302361 10/2000
JP 2001-97657 4/2001

* cited by examiner 31
32
34
34a
34b
34c
34d
35
36
37
38
39
3
3a
ELEVATOR HALL
HOISTWAY

ELEVATOR HALL DOOR AND DOOR HANGER APPARATUS

CROSS-REFERENCE TO RELATED APPLICATIONS

The present application is a divisional of U.S. application Ser. No. 10/070,427 filed on Mar. 18, 2002 now U.S. Pat. No 6,988,592, and in turn claims priority to JP2000-215696 filed on Jul. 17, 2000, and JP2001-016142 filed on Jan. 24, 2001, the entire contents of each of which are hereby incorporated herein by reference.

TECHNICAL FIELD OF THE INVENTION

The present invention relates generally to an elevator hall door and a door hanger apparatus. More specifically, the invention relates to an elevator hall door which is scarcely deformed by suffering from heat when a fire occurs in a building and which is capable of preventing smoke and fire from penetrating into a hoistway, and a door hanger apparatus for preventing fire from spreading to the next floors.

BACKGROUND ART

An elevator hall in a building is provided with a hall door serving as a gate to an elevator car. The hall door is usually shut securely to block the communication between the elevator hall and the side of a hoistway in which the elevator car travels upwardly and downwardly, and is open and closed synchronously with the opening and closing of the elevator car when the elevator car reaches the elevator hall.

The hoistway in which the elevator car is vertically movable is provided so as to vertically extends from the lowest floor to the highest floor of the building. In the hoistway, there is a governor rope hanging from a sheave, and a counterweight vertically movable in the opposite direction to the moving direction of the elevator. The wall of the hoistway and the elevator car allow a rather large space.

Therefore, since it is not completely possible to deny the possibility that the hoistway serves as a chimney extending in vertical directions when a fire occurs in the building, the elevator hall door is formed of a refractory material, such as a metal, so that the fire and smoke can hardly enter into the hoistway.

If a building fire occurs, there are some cases where the elevator hoistway serves as a passage for smoke and fire to sequentially introduce to the upper floor, causing further increased damage by the spread of the fire. The reason why smoke and fire enter into the hoistway is that the elevator hall door arranged on the elevator hall falls off due to the damaged deformation caused by heat so that the elevator hall gate serves as a smoke inlet.

FIG. 11 shows a elevator hall door which is utterly deformed by being exposed to heat caused by a fire on an elevator hall. In FIG. 11, reference number 1 denotes a door frame 1 which is fixed to a wall 2, and reference number 3 denotes an elevator hall door In FIG. 11, the left side is a hoistway, and the right side is an elevator hall. Reference number 4 denotes a header case which is fixed to the top side portion of the entrance of the wall 2, and reference number 5 denotes a sill which is fixed to a gate floor 6. A hanger roller 7 is supported on a hanger 8 which is mounted on the top end portion of the elevator hall door 3. On the other hand, a hanger rail 9 with which the hanger roller 7 engages so as to be capable of rolling thereon is mounted on the header case 4, and the elevator hall door 3 is open and closed while the hanger roller 7 rolls on the hanger rail 9. On the bottom end portion of the elevator hall door 3, a guide shoe 10 sliding in a guide groove of the sill 5 is mounted.

As shown in FIG. 12, the door panel of the hoistway door 3 comprises a surface board 11 constituting a design surface, a back board 12, and a reinforcing member 13 for reinforcing them.

If the elevator hall door 3 is exposed to heat when a fire occurs in the building, the door panel of the elevator hall door 3 starts to be gradually deformed so as to be warped as shown in FIGS. 11 and 12. If the elevator hall door 3 is further exposed to heat, the elevator hall door 3 falls away from the hanger rail 9 and the sill 5, allowing fire and smoke to enter into the hoistway from opening space of the elevator hall, so that there is the possibility of spreading the fire to upper floors.

To taking countermeasures for preventing such a hazardous situation, there are know measures to utilize elongated holes, which are provided in connecting portions of the back board 12 to the surface board 11 and the reinforcing member 13 for allowing them to slide in vertical directions, to absorb the difference in heat expansion between the back board 12 and the surface board 11 and reinforcing member 13. These elongated holes enable the door panel to suppress the deformation to prevent from falling off.

However, although the above described conventional elevator hall door can absorb the difference in elongation in vertical directions between the back board 12 and the surface board 11 and reinforcing member, the door panel of the elevator hall door is restricted in depth and lateral directions, so that it is insufficient to suppress the deformation of the door panel even if the deformation is suppressed to some extent.

In addition, all of component parts of the door hanger apparatus of the elevator hall door 3 are difficult to be formed of fire resistant materials for structural reasons. For example, the hanger roller on the reverse side of the header case 1 on the elevator platform is provided with a cushioning material, such as a plastic, at least on the outer peripheral surface thereof in order to ensure the quietness of operation of the elevator hall door.

Although the cushioning material itself does not easily melt by using a fire-resistant plastic material or the like, it is considered that the cushioning material melts due to heat of a high temperature during a fire in a special case beyond expectations.

If the melted cushioning material falls while it has heat of a high temperature, if a part thereof enters the hoistway from the elevator hall door 3, and if a lubricating oil or the like exists in the hoistway in the vicinity thereof, it is considered that the melted cushioning material takes fire to cause a secondary fire.

It is therefore an object of the present invention to eliminate the above described problems in the prior art and to provide an elevator hall door capable of suppressing the deformation of a door panel to prevent the falling of the elevator hall door and to prevent smoke and fire from entering into a hoistway to prevent the spread of the fire, by preventing a back board, a surface board and a reinforcing member from being restricted in all directions when a differential thermal expansion occurs between the back board, the surface board and the reinforcing member.

It is another object of the present invention to provide an elevator hall door hanger apparatus which is capable of preventing a cushioning material of a hanger roller from entering a hoistway to prevent the spread of the fire even if the elevator hoistway door is heated to melt the cushioning material of the hanger roller during a fire.

In order to accomplish the above described objects, according to a first aspect of the present invention, there is provided an elevator hall door for closing and opening an entrance on an elevator hall, said elevator hall door comprising a door panel comprising a surface board facing a elevator hall, a back board facing a hoistway, and a reinforcing member for reinforcing said surface and back boards; and a connecting member configured to connect said back board to said surface board or said reinforcing member, wherein at least a part of said connecting member is capable of losing the force of constraint against said surface board or said reinforcing member on high temperature conditions during a fire.

According to this aspect of the present invention, if the difference in elongation due heat between the surface board and/or reinforcing member, which are exposed directly to heat of a high temperature by a fire in a building, and the back board increases, the door penel intends to be deformed. However, the connecting member is broken or melts by the high temperature to lose the force of constraint, so that the surface board and the reinforcing member are in an elongated state without constraint in specific directions. Thus, it is possible to prevent the whole door panel from being deformed.

According to a preferred embodiment of the present invention, the connecting member comprises a steel rivet of a steel product for connecting one end portion of the door body, and a low-melting-point or low strength aluminum rivet of aluminum for connecting the remaining portion of the door body to be used as the connecting member. Thus, even if the aluminum rivet is disengaged, the steel rivet holds the surface board and/or the reinforcing member to inhibit these members from falling.

The connecting member may comprise a rivet having a smaller head than a rivet hole which is formed in a connecting portion of the back board, and a resin or rubber washer which is provided between the head of the rivet and the back board, or may comprise a bolt, and a resin or rubber nut which forms a counterpart to the bolt.

According to a second aspect of the present invention, there is provided an elevator hall door hanger apparatus for suspending a elevator hall door, which has a front face facing an elevator hall and a back face facing a hoistway of the elevator, in an entrance on the hall, said door hanger apparatus comprising a hanger member having a substantially L-shaped cross section, said hanger member comprising a short piece which is fixed on the upper portion of said door, and a long piece which rises along the back face of said door; a plurality of hanger rollers which are rotatably mounted on said hanger member and each of which has a cushioning member at least on the outer peripheral surface thereof; a guide rail which is supported by the entrance on the hall so as to extend in horizontal directions to guide said plurality of hanger rollers; and penetration preventing means configured to prevent material of said cushioning member, which melts on high temperature conditions, from flowing along said hanger member to enter into said hoistway.

According to this aspect of the present invention, even if the elevator hoistway door receives heat during a fire to melt the material of the cushioning material of the hanger roller, the cushioning material entering inhibiting means causes the melted material to flow toward the platform on the side of the front face of the hoistway door to prevent the melted material from flowing to the hoistway on the side of the back face, so that it is possible to prevent the melted material from taking fire to cause the secondary spread of the fire.

DETAILED DESCRIPTION OF THE PREFERRED EMBODIMENTS

Referring to the accompanying drawings, a preferred embodiment of an elevator hall door according to the present invention will be described below.

Figure 1:
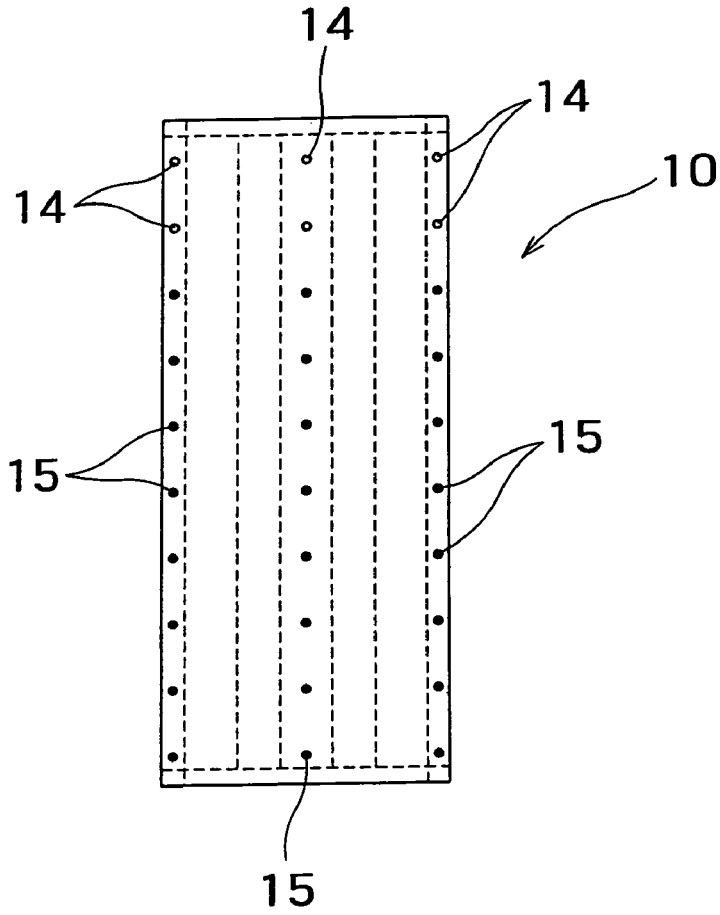
FIG. 1 is a plan view of a door panel of a preferred embodiment of an elevator hall door according to the present invention.
Figure 2:
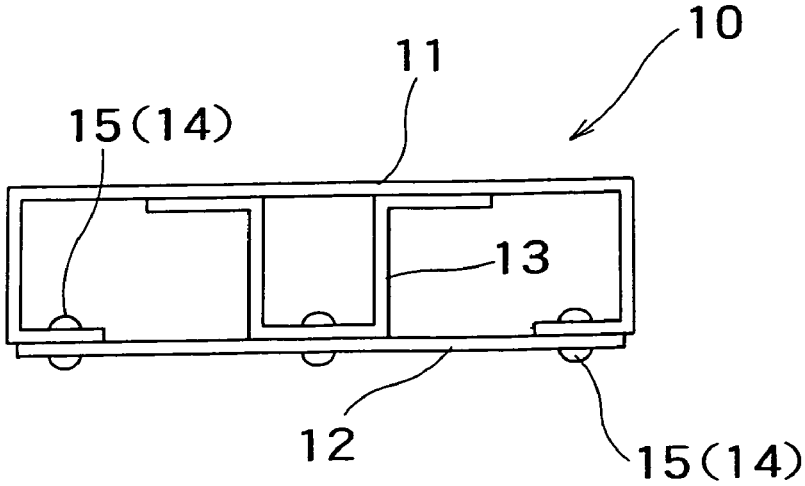
FIG. 2 is a sectional view of the door panel in this preferred embodiment.

FIG. 1 is a plan view of a door panel 10 of an elevator hall door in this preferred embodiment, and FIG. 2 is a sectional view of the door panel 10. The door panel 10 comprises a surface board 11, a back board 12 and a reinforcing member 13, which are fastened to each other by two kinds of rivets 14 and 15. The surface board 11 is a member facing an elevator platform and forming a dressed surface. Mounting the door body 10 in the entrance of the elevator platform, the back board 13 faces a hoistway.

As shown in FIG. 1, the rivets 14 (shown by white ○ in FIG. 1) are rivets made of steel, which are conventionally used for fastening metal plate members, such as the surface board 11, the back board 12 and the reinforcing member 13. In this preferred embodiment, the steel rivets 14 are used at fastening portions on the upper end of the door panel 10. On the other hand, the rivets 15 (shown by ● in FIG. 1) are aluminum rivets made of an aluminum or aluminum alloy material which have a lower melting point and a lower shearing strength than those of the steel rivets 14. The rivets 15 melt down if the rivets 15 are exposed to a high temperature due to a fire occurred to the building, and the rivets 15 are broken if a higher shearing stress more than a certain limit is applied thereto.

Thus, in the door panel 10, the surface board 11 and the reinforcing member 13 are connected to each other by the back board 12 and the aluminum rivets 15. Therefore, if a fire occurs in the building, any one of the aluminum rivets 15 serves to remove restrictions between the surface board 11, the reinforcing member 13 and the back board 12. That is, if the fire occurs in the building, the surface board 11 and reinforcing member 13 of the door body 10 are exposed directly to a flame and intense heat. However, since the back board 12 is shielded by the surface board 11, the degree of elongation of the back board 12 is small although the degree of elongation of the surface board 11 and reinforcing member 13 due to heat is large. For that reason, the difference between the elongation of the back board 12 due to heat and the elongation of the surface board 11 and reinforcing member 13 due to heat is increases remarkably. By this difference in elongation, a sharing stress acts on the aluminum rivets 15, and the sharing stress increases as the difference in thermal expansion increases. Then, some of the aluminum rivets 15, on which a sharing stress exceeding a predetermined limit acts and/or which melt down by heat to have a weak strength, start to be broken. As the number of the aluminum rivets 15 which have lost the force of constraint is gradually increasing, the constraint of the surface board 11 and reinforcing member 13 by the back board 12 is being lost, so that the surface board 11 and the reinforcing member 13 are in an elongated state without constraint in specific directions (in a state that the surface board 11 is not warped). Thus, it is possible to prevent the whole door panel 10 from being deformed.

Therefore, even if the door panel 10 is deformed, the aluminum rivets 15 exclusively loose and fall out, and the door panel 10 is not disengaged and does not fall away from the hanger rail and the sill, so that it is possible to prevent flame and smoke from entering into the hoistway. In addition, since the top end portion of the door panel 10 is connected by the usual steel rivets 14, even if all of the aluminum rivets 15 melt down to be disengaged, there is not the possibility that the surface board 11 and the reinforcing board 13 fall due to the differences in strength and melting point based on the difference in material since the surface board 11 and the reinforcing board 13 are held by the steel rivets 14.

Figure 3:
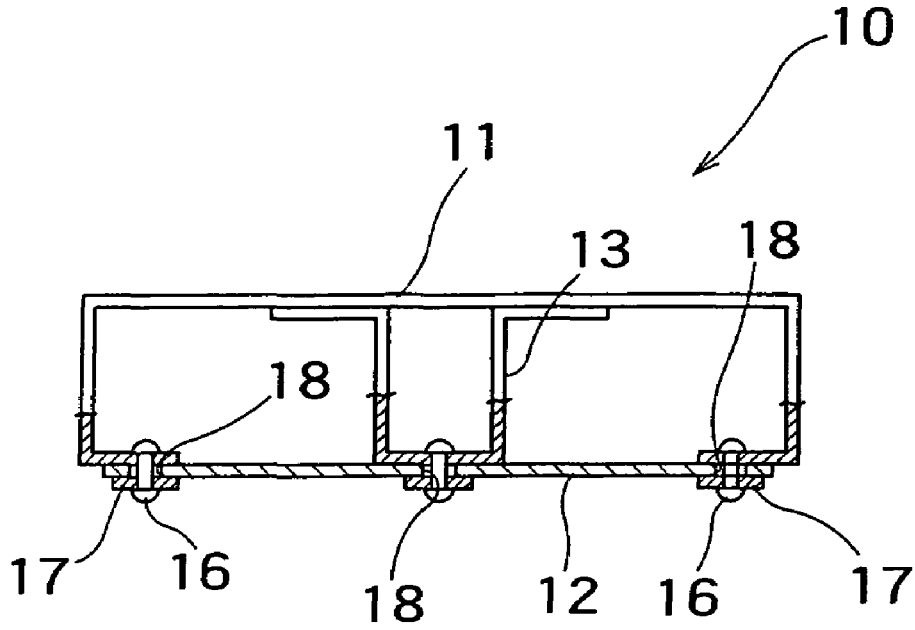
FIG. 3 is a sectional view of a door panel in another preferred embodiment.
Figure 4:
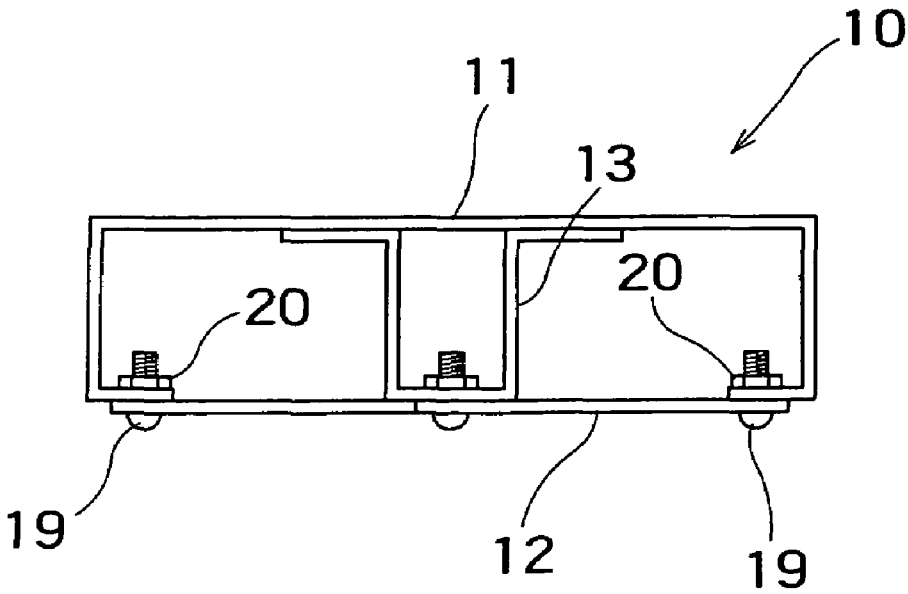
FIG. 4 is a sectional view of a door panel in a further preferred embodiment.

FIGS. 3 and 4 show a cross section of another preferred embodiment of a door panel 10 according to the present invention.

FIG. 3 shows a preferred embodiment wherein steel rivets 16 are combined with plastics or rubber washers 17 in place of the aluminum rivets 15. In this case, the diameter of a rivet hole 18 of the back board 16 is greater than the diameter of the head portion of the steel rivet 16, and the washer 17 is provided between the head of the steel rivet 16 and the back board 12.

Therefore, since the washers 17 melt down and fall off, suffering from intense heat during the fire, the force of constraint of the steel rivets 16 disappears, so that the surface board 11 and the reinforcing board 13 are in an elongated state without constraint in specific directions. Thus, it is possible to prevent the whole door panel 10 from being deformed.

FIG. 4 shows a preferred embodiment wherein bolts 19 are combined with rubber nuts 20 in place of the aluminum rivets 15. Since the nuts 20 melt and fall off on high temperature conditions so that the force of constraint of the bolts 19 disappears similar to the preferred embodiment of FIG. 3, it is possible to prevent the door body 10 from being deformed.

Referring to FIGS. 5 through 10, a preferred embodiment of an elevator hall door hanger apparatus according to the present invention will be described below in detail.

Figure 5B:
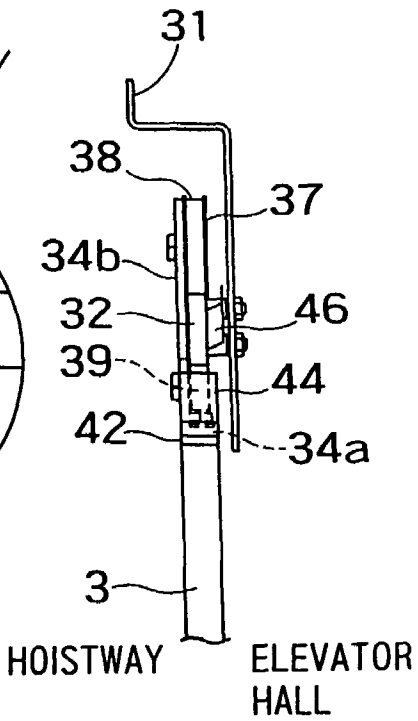
FIG. 5(*a*) is a back view of an upper portion of a preferred embodiment of an elevator hall door hanger apparatus according to the present invention, and FIG. 5(*b*) is a right side view of FIG. 5(*a*)
Figure 5A:
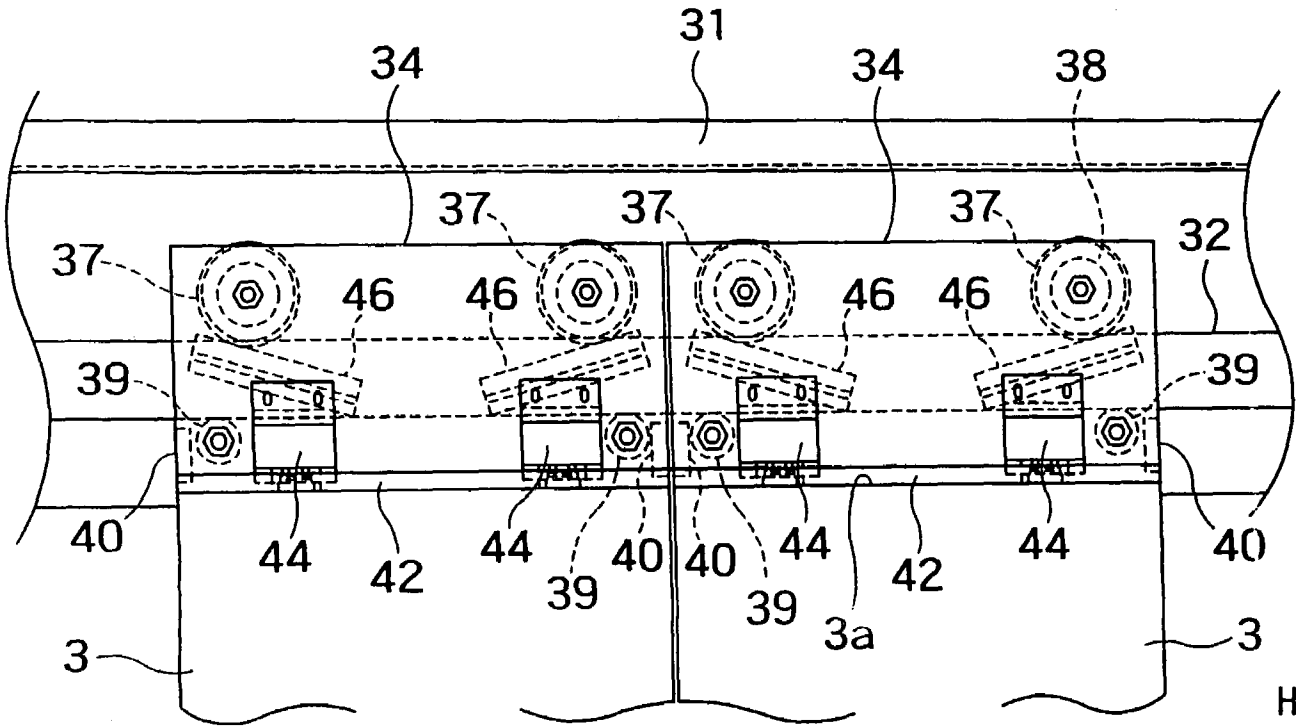

FIG. 5 shows a principal part of a preferred embodiment of an elevator hall door hanger apparatus according to the present invention, wherein FIG. 5(*a*) is a top back view of an upper portion of the door hanger apparatus when the elevator hall door is viewed from the side of the hoistway, and FIG. 5(*b*) is a right side view of FIG. 5(*a*).

As shown in FIG. 5, the upper portion of the entrance on the elevator hall is provided with a header case 31 which is mounted on a side of a door frame (not shown) or the like. On the header case 31, a guide rail 32 extending in horizontal directions so as to be spaced from the back surface of the header case 31 is supported. The guide rail 32 is designed to guide hoistway doors 3 which are suspended from hanger members 34.

The two elevator hall doors 3 make a pair, and FIG. 5(*a*) shows a state that the elevator hall doors 3 close the entrance. However, only one elevator hall door 3 may be provided, or two elevator hall doors 3 may be provided so as to overlap with each other and move in the same directions to be open and closed. The present invention may be applied to any one of the elevator hall doors 3. On the top end portions of the elevator hall doors 3, the hanger members 34 are mounted, respectively. The details of the hanger members 34 are shown in the upper back view of FIG. 6(*a*) and the right side view of FIG. 6(*b*). In order to facilitate better understanding of the construction of the hanger members 34, the constructions of the hanger members 34 in addition to the header case 31, the guide rail 32 and the hoistway doors 3 are mainly shown, and other members, such as a guide member 40, a shim member 42 and a cover 44 (these members will be described later), which are shown in FIG. 1, are omitted.

Each of the hanger members 34 is a strip-like structural angle which comprises a short piece 34*a* and a long piece 34 extending in directions perpendicular thereto and which is formed so as to have a substantially L-shaped cross section. The hanger member 34 is mounted so that the short piece 34*a* extends from the long piece 34*b* toward the front surface of the elevator hall door 3. Preferably, the short piece 34*a* has a width which is substantially equal to the thickness of the hoistway door 3, and is fixed to the top end surface 3*a* of the elevator hall door 3. On the other hand, the long piece 34*b* rises perpendicularly from the short piece 34*a* so as to have the same plane as that of the back face of the elevator hall door 3 (the surface of the door 3 facing the hoistway will be hereinafter referred to as the back surface, and the surface of the door 3 facing the elevator hall will be hereinafter referred to as a front surface). The width of such a hanger member 34 is set to be substantially equal to the width of the elevator hall door 3.

Therefore, in a state that the two hoistway doors 3 are securely shut, the adjacent vertical edge portions 34*c* and 34*d* of the right and left hanger members 34 and 34 contact each other, and a gap is hardly formed therebetween.

The lower portion of the long piece 34*b* of the hanger member 34 is formed with notch portions 35. The spaces of the notch portions 35 are utilized for facilitating the fastening of fasteners, such as bolts 36, when the short piece 34*a* of the hanger member 34 is fastened and fixed on the top face 3*a* of the elevator hall door 3.

On the top portion of the hanger member 34 on the side of the front surface thereof, a pair of hanger rollers 37 are rotatably provided at an interval in horizontal directions. The hanger rollers 37 are designed to roll along the top edge portion of the guide rail 32 in accordance with the opening and closing of the elevator hall door 3. In order to maintain the smooth opening and closing of the elevator hall door 3, each of the hanger rollers 37 is formed of a cushioning material 38, such as a plastic material or a rubber material. Alternatively, each of the hanger rollers 37 comprises a roller wherein a cushioning material 38, such as a plastic material, is attached onto an outer circumferential surface of a metal member serving as a core.

Furthermore, in order to prevent the hanger rollers 37 from falling away from the guide rail 32, the hanger member 34 is provided with a pair of auxiliary rollers 39 which roll along the bottom edge portions of the guide rail 32.

According to this preferred embodiment, the width of the hanger member 34 in longitudinal directions is arranged to be substantially equal to the width of the elevator hall door 3 as described above. Therefore, for example, in a state that the pair of the elevator hall doors 3 are shut securely, no gap is formed between the adjacent edge portions 34*c* and 34*d* of the two hanger members 34 and 34. In addition, the hanger member 34 is mounted on the top end portion of the elevator hall door 3 so that the short piece 34*a* extends from the long piece 34*b* toward the front surface of the elevator hall door 3. Therefore, even if a fire occurs in the building to melt the materials of the cushioning materials 38 of the hanger rollers 37, the melted materials of the cushioning materials 38 flow toward the hoistway, i.e., toward the front surface of the elevator hall door 3, along the short piece 34*a*, so that it is possible to prevent the melted materials of the cushioning materials 38 from entering into the hoistway on the opposite side, in which there is the possibility that the melted materials will catch fire.

In addition, since the width of the hanger member 34 is arranged to be substantially equal to the width of the elevator hall door 3, it is possible to prevent the melted materials of the cushioning materials 38 from passing around both right and left ends of the hanger member 34 to enter the hoistway on the opposite side.

Figures 6A, 6B:
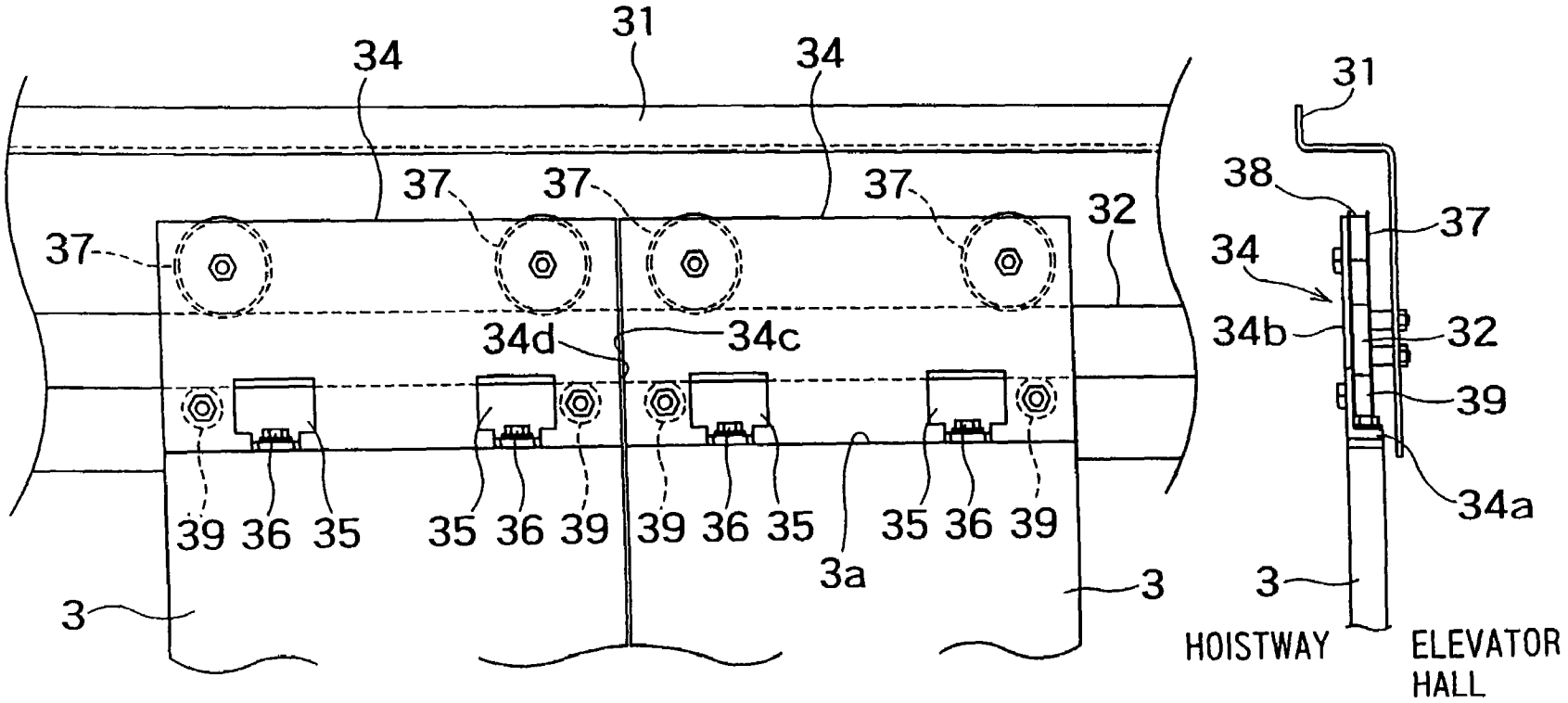
FIG. 6(*a*) is a back view of an upper portion of a door hanger apparatus, which shows a principal part of FIG. 6(*a*), and FIG. 6(*b*) is a right side view of FIG. 6(*a*)

In the preferred embodiment shown in FIGS. 5 and 6, as described above, the width of the hanger member 34 in longitudinal directions is set to be substantially equal to the width of the elevator hall door 3 as a first penetration preventing means, and the hanger member 34 is fixed to the elevator hall door 3 so that the short piece 34*a* extends from the long piece 34*b* toward the front surface of the elevator hall door 3. Thus, the melted materials of the cushioning materials 38 are prevented from entering the hoistway. If such a hanger member 34 is combined with various penetration preventing means which will be described later, it is possible to more surely prevent the melted materials of the cushioning materials 38 from entering into the hoistway.

Figure 7A:
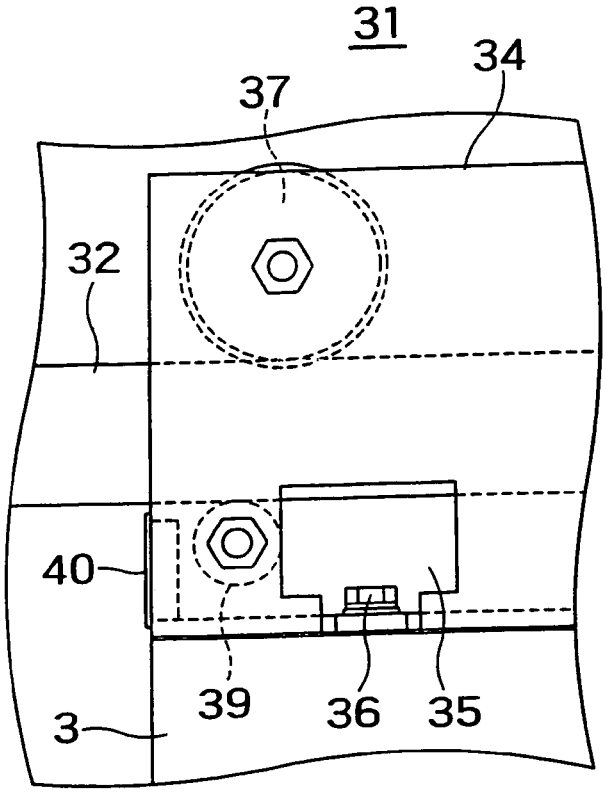
FIG. 7(*a*) is an enlarged view showing a part of FIG. 5(*a*), and FIG. 7(*b*) is a left side view of FIG. 7(*a*)
Figure 7B:
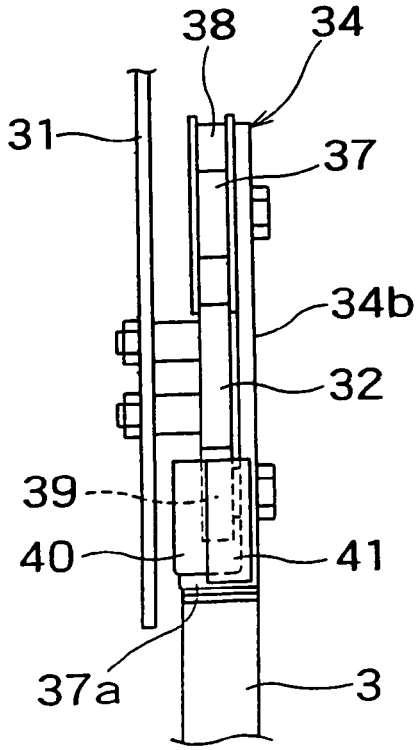

Referring to FIGS. 5 and 7, a second penetration preventing means will be described below. The second penetration preventing means comprises L-shaped cap members 40 which are mounted on L-shaped corner portions in lower portions of both right and left end portions of the hanger member 34, so that both of the corner portions are blocked with the cap members 40. Furthermore, FIG. 7(*a*) is an enlarged view showing one of enlarged end portions of the hanger member 34, and FIG. 7(*b*) is a left side view thereof.

In the substantially L-shaped corner portion formed by the edge portions of the short piece 34*a* and long piece 34*b* of the hanger member 34, the short piece 34*a* and the long piece 34*b* contact substantially perpendicular to two sides of the cap member 40 to be fixed thereto by welding using a strapped joint 41 or the like so that no gap is formed therebetween. However, the width of the cap member 40 must be substantially equal to that of the short piece 34*a*, and the height of the cap member 40 must be smaller than the distance between the short piece 34*a* of the hanger member 34 and the guide rail 32 so that the cap member 40 does not interfere with the guide rail 32. If the corner portions of the lower portions of both right and left end portions of the hanger member 34 in longitudinal directions are thus closed with the cap members 40, the bottom portion of the hanger member 34 can be formed so as to have a gutter shape which is open toward the front surface of the elevator hall door 3.

As a result, even if the materials of the cushioning materials 38 of the hanger rollers 37 melt away to flow along the front surface of the long piece 34*b* of the hanger member 34, the penetration of the melted materials of the cushioning materials 38 on the short piece 34*a* is prevented, and the melted materials of the cushioning materials 38 are prevented from entering into the hoistway, since both corner portions of the hanger member 34 are covered with the cap members 40.

Figure 8A:
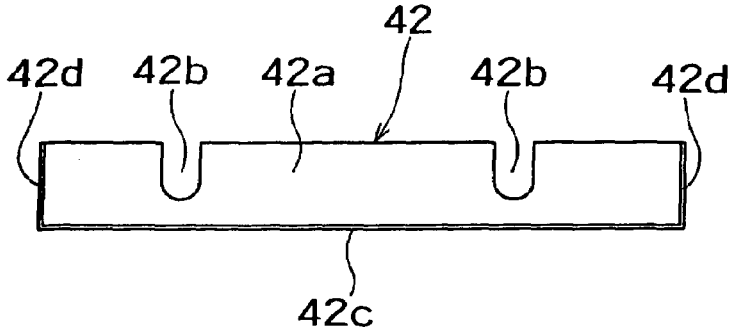
FIG. 8(*a*) is a plan view of a shim member shown in FIG. 5, and FIG. 8(*b*) is a right side view of FIG. 8(*a*)
Figure 8B:
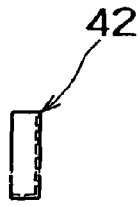

Referring to FIGS. 5 and 8, a third penetration preventing means will be described below.

The third entering inhibiting means is provided between the short piece 34*a* of the hanger member 34 and the top surface 3*a* of the elevator hall door 3, and comprises a shim member 42 for receiving the hanger member 34. The shim member 42 may be used with the cap member 40 which is the second penetration preventing means, or may be used alone. Furthermore, FIG. 8(*a*) is a plan view showing the shim member 42, and FIG. 8(*b*) is a right side view thereof.

The shim member 42 comprises a laterally elongated metal thin plate having an L-shaped cross section which is formed by a bottom face portion 42*a* and a back face wall 42*c*. The whole length of the shim member 32 in lateral directions is substantially equal to the width of the elevator hall door 3, and the width of the bottom surface portion 42*a* is substantially equal to the thickness of the elevator hall door 3. A part of the flat bottom surface 23*a* is formed with notch portions 42*b* to mount it on the hanger member 34. The corner portions formed by the bottom surface portion 42*a* and back face wall 42*c* on both ends of the shim member 42 in longitudinal directions are closed with side wall portions 42*d* which rise from the bottom face portion 42*a* by the same height as that of the back surface wall 42*c*. Furthermore, the height of the side wall portion 42*d* is arranged so as not to reach the guide rail 2 in order to prevent the side wall portion 42*d* from touching on the guide rail 2.

Since the shim member 42 with the above described constructions can receive the short piece 34*a* of the hanger member 34 on the bottom surface portion 42*a*, the shim member 42, together with the hanger member 34, is fixed on the elevator hall door 3 by means of fasteners, such as bolts 6, via the notch portions 42*b*, so that the shim member 42 is provided between the short piece 34*a* of the hanger member 34 and the elevator hall door 34. The shim member 42 thus provided has a pan shape which surrounds the lower portion of the hanger member 34 in three directions and which is open on the side of the front surface of the elevator hall door 3. For that reason, the melted materials of the cushioning materials 38 of the hanger rollers 37 due to intense heat are guided to flow along the long piece 34*b* of the hanger member 34. The melted materials are received by the shim member 34 to flow toward the front surface of the open hall door 3, so that the side wall portion 42*d* prevents the materials from entering into the hoistway.

Figure 9A:
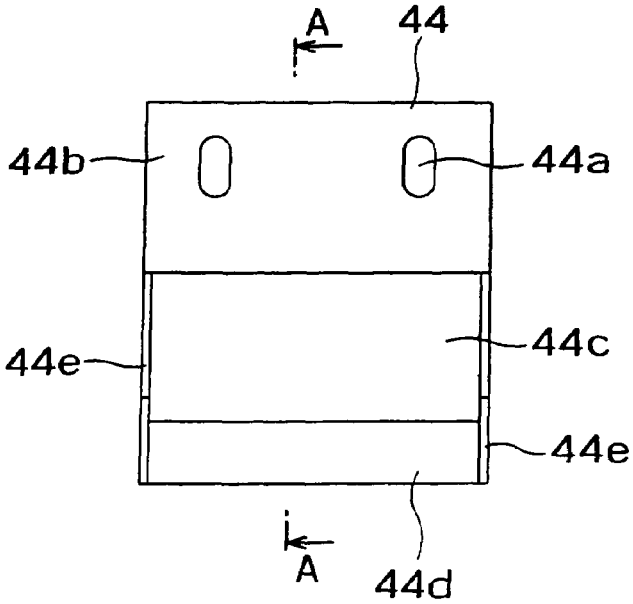
FIG. 9(*a*) is a back view of a cover member shown in FIG. 5, and FIG. 9(*b*) is a right side view of FIG. 9(*a*)
Figure 9B:
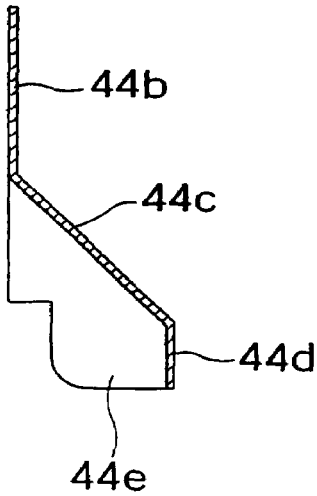

Referring to FIGS. 5 and 9, a fourth penetration preventing means will be described below.

The fourth penetration preventing means is designed to block and close each of the notch portions 35 by a cover member 44 shown in FIG. 9, in order to prevent the melted materials of the cushioning materials 38 from entering into the hoistway from the notch portions 35 which are formed in the hanger member 34. Furthermore, FIG. 9(*a*) is a back view of the cover member 44, and FIG. 9(*b*) is a sectional view taken along line A—A of FIG. 9(*a*).

The cover member 44 is a metal thin plate member integrally formed by a flat plate portion 44*b*, an inclined portion 44*c* which extends from the flat plate portion 44*b* and which has a down incline, a vertical portion 44*d* which extends from the inclined portion 44*c*, and side plate portions 44*e* which rise from both ends of the inclined portion 44*c* and vertical portion 44*d*. The flat plate portion 44*b* is formed with long holes 44*a* to insert screws. Furthermore, the width of the cover member 44 is substantially equal to the width of the cut-out portion 35, and the vertical height from the inclined portion 44*c* to the vertical portion 44*d* is substantially equal to the height of the cut-out portion 35. In addition, the vertical distance between the flat plate portion 44*b* and the vertical portion 44*d* is preferably substantially equal to the width of the elevator hall door 3.

With this construction, the cover member 44 is mounted as follows in order to block the notch portion 35 after the hanger member 34 is fixed to the elevator hall door 3 by fasteners, such as bolts 36, in FIG. 5. That is, the inclined portion 44*c* of the cover member 44 is inserted into the notch portion 35 from the back surface (the hoistway side) of the hanger member 34 to cause the tip portion of the vertical portion 44*d* of the cover member 44 to touch the short piece 21*a* of the hanger member 34, and in this state, screws are caused to pass through the long holes 44*a* to fix the flat plate portion 44*b* of the cover 44 to the long piece 34*b* of the hanger member 34. Then, as shown in FIG. 9(*b*), the notch portion 35 is closed and blocked by the inclined portion 44*c* and vertical portion 44*d* of the cover member 44.

If the shim member 42 serving as the above described third penetration preventing means is herein provided, the side plates 44*e* of the cover member 44 are cut out by a length corresponding to the height of the wall surface 42*c* so as not to interfere with the wall surface 42*c*.

If the material of the cushioning material 38 of the hanger roller 37 melts down with intense heat to flow along the long piece 34*b* of the hanger member 34 during a fire, there is the possibility that a part of the melted material flows into the hoistway from the notch portion 35 which is formed in the hanger member 34. However, by providing the cover member 44 for closing the notch portion 35 as described above, the melted material of the cushioning material 3 a flows on the inclined portion 44*c* of the cover member 44 to be received by the short piece 21*a* of the hanger member 21 or the shim member 23, or to fall on the side of the front face of the elevator hall door 3, so that the melted material does not to enter into the hoistway.

Figure 10:
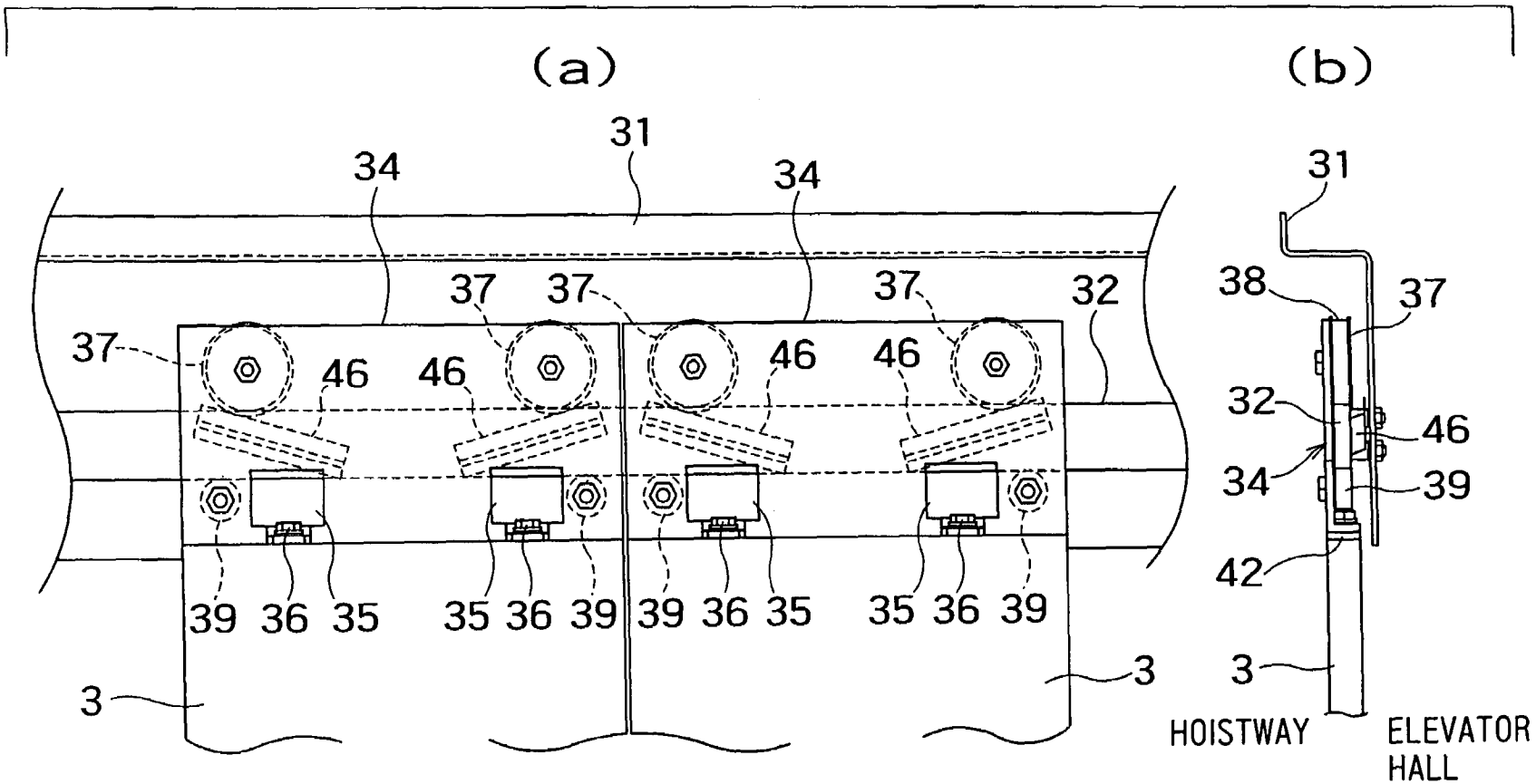
FIG. 10(*a*) is a back view of a principal part of a door hanger apparatus shown in FIG. 5, and FIG. 10(*b*) is a right side view of FIG. 10(*a*)
Figure 11:
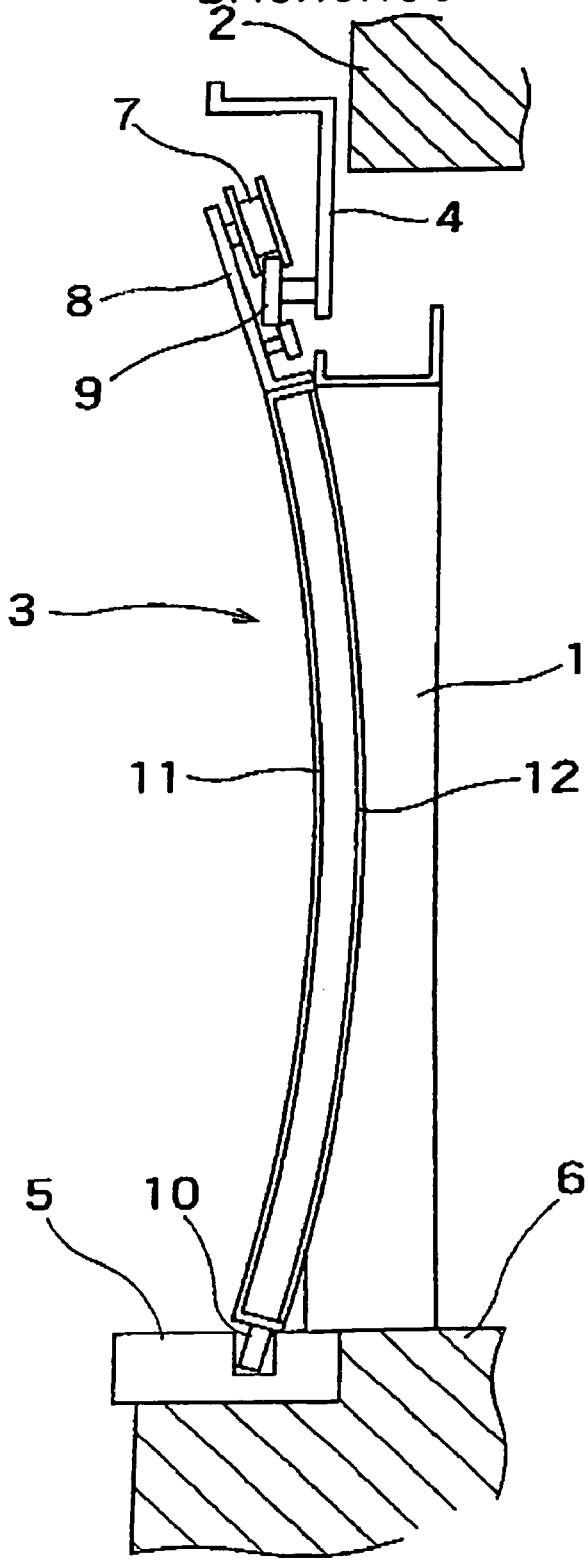
FIG. 11 BACKGROUND ART
FIG. 11 is a longitudinal sectional view showing a conventional elevator hall door which is deformed during a fire.
Figure 12:
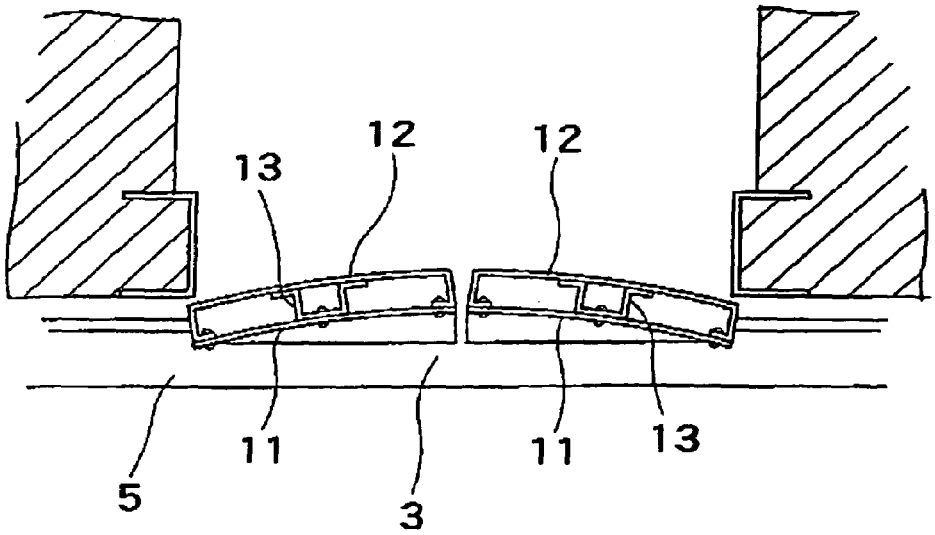
FIG. 12 BACKGROUND ART
FIG. 12 is a cross sectional view showing a conventional elevator hall door which is deformed during a fire.

Referring to FIGS. 5 and 10, a fifth penetration preventing means will be described below.

The fifth penetration preventing means comprises gutter members 46 which are inclined down from the edges of the elevator hall door 3 toward the central portion thereof and which are provided on the guide rail 32 below the hanger rollers 37 when the elevator hall door 3 is shut. Furthermore, FIG. 10 is viewed from the same direction as those of FIGS. 5 and 6. FIG. 10(*a*) is a back view, and FIG. 10(*b*) is a right side view In order to facilitate better understanding of the constructions of the gutter members 46, FIG. 10 mainly shows the header case 31, the guide rail 32, the elevator hall door 3 and the hanger member 34 in addition to the gutter members 46, and omits other members.

Since the gutter members 46 are thus provided so as to be inclined down toward the central portion, even if the materials of the cushioning materials 38 of the hanger rollers 37 melt down with intense heat, the materials of the cushioning materials 38 flowing along the surface of the guide rail 32 are received by the gutter members 46, to fall in the vicinity of the central portion of the top surface 3*a* of the hoistway door 3 to be received by the short piece 34*a* of the hanger member and/or the shim member 23, or to fall on the side of the front face of the elevator hall door 3.

Therefore, it is possible to surely prevent the melted cushioning member 38 from flowing toward both right and left ends of the hanger member 34 to enter into the hoistway.

The invention claimed is:

1. An elevator hall door hanger apparatus for suspending an elevator hall door, which has a front face facing an elevator hall and a back face facing a hoistway of the elevator, in an entrance on the hall, said door hanger apparatus comprising:

a hanger member having a substantially L-shaped cross section, said hanger member comprising a short piece which is fixed on the upper portion of said door, and a long piece which rises along the back face of said door;

a plurality of hanger rollers which are rotatably mounted on said hanger member and each of which has a cushioning member at least on the outer peripheral surface thereof;

a guide rail which is supported by the entrance on the hall so as to extend in horizontal directions to guide said plurality of hanger rollers; and penetration preventing means configured to prevent material of said cushioning member, which melts on high temperature conditions, from flowing along said hanger member to enter into said hoistway, wherein said penetration preventing means is said hanger member having a width which is substantially equal to the width of said door.

2. An elevator hall door hanger apparatus according to claim 1, wherein said penetration preventing means comprises a cap member for closing the corner portions of said hanger member on both ends in longitudinal directions.

3. An elevator hall door hanger apparatus according to claim 1, wherein said penetration preventing means comprises a shim member having a substantially L-shaped cross section, said shim member being provided between the top surface of said door and the short piece of said hanger member, the corner portions of said shim member on both ends in longitudinal directions being closed.

4. An elevator hall door hanger apparatus according to claim 1, wherein said penetration preventing means comprises a cover member for closing a notch portion, which is formed in said long piece of said hanger member and which is used for fixing said hanger member to said door, from the back surface of said door.

5. An elevator hall door hanger according to claim 1, wherein said penetration preventing means comprises a gutter member which is mounted on said guide rail below said hanger roller when said door is closed and which is inclined down toward the central portion of said door.

* * * * *